US009394137B2

(12) United States Patent
Ando et al.

(10) Patent No.: US 9,394,137 B2
(45) Date of Patent: Jul. 19, 2016

(54) PAPER SHEET HANDLING APPARATUS

(71) Applicant: FUJITSU FRONTECH LIMITED, Tokyo (JP)

(72) Inventors: Atsushi Ando, Inagi (JP); Tomoyuki Tamahashi, Inagi (JP); Kazuhiko Kawase, Inagi (JP); Yuji Katoh, Inagi (JP); Jiro Nakamura, Inagi (JP)

(73) Assignee: Fujitsu Frontech Limited, Tokyo (JP)

( * ) Notice: Subject to any disclaimer, the term of this patent is extended or adjusted under 35 U.S.C. 154(b) by 0 days.

(21) Appl. No.: 14/681,580

(22) Filed: Apr. 8, 2015

(65) Prior Publication Data

US 2015/0210502 A1 Jul. 30, 2015

Related U.S. Application Data

(63) Continuation of application No. PCT/JP2012/051673, filed on Jan. 25, 2013.

(51) Int. Cl.
*B65H 43/04* (2006.01)
*G07D 11/00* (2006.01)
(Continued)

(52) U.S. Cl.
CPC ..... *B65H 43/04* (2013.01); *B65H 1/025* (2013.01); *B65H 31/26* (2013.01); *B65H 33/02* (2013.01); *B65H 37/00* (2013.01); *G07D 11/0018* (2013.01); *G07D 11/0036* (2013.01); *G07D 11/0063* (2013.01); *B65H 2511/521* (2013.01); *B65H 2515/34* (2013.01); *B65H 2701/1912* (2013.01)

(58) Field of Classification Search
CPC ..... B65H 43/04; B65H 37/00; B65H 33/02; B65H 31/26; B65H 2511/521; G07D 11/0063; G07D 11/0018; G07D 11/0036
See application file for complete search history.

(56) References Cited

U.S. PATENT DOCUMENTS 4,883,264 A 11/1989 Yoshikawa et al.
6,137,968 A * 10/2000 Sunou ..... B65H 7/02 271/153

(Continued)

FOREIGN PATENT DOCUMENTS

JP 07-76993 8/1995
JP 08-030843 2/1996

(Continued)

OTHER PUBLICATIONS

Translation of Japanes document JP 2008-216851 cited by applicant.*

(Continued)

*Primary Examiner* — David H Bollinger
(74) *Attorney, Agent, or Firm* — Greer Burns & Crain Ltd.

(57) ABSTRACT

A paper sheet handling apparatus includes: a paper sheet insertion unit into which a plurality of paper sheets are inserted; a first plate provided at the paper sheet insertion unit; a second plate provided at the paper sheet insertion unit and that holds the plurality of paper sheets in a sandwiching manner with the first plate; a pressure distribution sensing sheet provided to at least one of the first or second plate and that senses a pressure distribution on the plurality of paper sheets held by the first and second plates; and a controlling unit that determines the presence/absence of a foreign body according to the pressure distribution sensed by the pressure distribution sensing sheet.

3 Claims, 11 Drawing Sheets

(51) Int. Cl.

| | |
|---|---|
| ***B65H 31/26*** | (2006.01) |
| ***B65H 33/02*** | (2006.01) |
| ***B65H 37/00*** | (2006.01) |
| ***B65H 1/02*** | (2006.01) |

(56) References Cited

U.S. PATENT DOCUMENTS

| | | | | |
|---|---|---|---|---|
| 8,854,056 | B1 * | 10/2014 | Furuhira | G01N 27/22 271/227 |
| 2002/0060421 | A1 * | 5/2002 | Kako | B65H 7/02 271/259 |
| 2005/0006199 | A1 * | 1/2005 | Brugger | B65H 7/06 194/347 |
| 2006/0055105 | A1 * | 3/2006 | Kawaguchi | B65H 7/02 271/265.04 |
| 2007/0273083 | A1 * | 11/2007 | Imai | B65H 1/14 271/152 |
| 2008/0035446 | A1 | 2/2008 | Yoshida et al. | |
| 2008/0219726 | A1 | 9/2008 | Fukai | |
| 2013/0320611 | A1 * | 12/2013 | Kubo | B65H 3/0615 271/114 |

FOREIGN PATENT DOCUMENTS

| | | |
|---|---|---|
| JP | 08-335288 | 12/1996 |
| JP | 2003-281602 | 10/2003 |
| JP | 2008-040876 | 2/2008 |
| JP | 2008-210303 | 9/2008 |
| JP | 2008-216851 | 9/2008 |
| JP | 2011-062330 | 3/2011 |
| SG | 145623 | 9/2008 |

OTHER PUBLICATIONS

Int'l. Search Report issued in Int'l. App. No. PCT/JP2013/051673, mailed Feb. 19, 2013.

Written Opinion of Int'l. Searching Authority for Int'l. App. No. PCT/JP2013/051673, mailed Feb. 19, 2013 (with partial translation).

Notice of Rejection Grounds issued in corresponding Japanese App. No. 2014-558400, mailed Sep. 15, 2015 (with partial translation).

* cited by examiner

PAPER SHEET HANDLING APPARATUS

CROSS-REFERENCE TO RELATED APPLICATION

This application is continuation application of International Application PCT/JP2013/051673 filed on Jan. 25, 2013 and designated the U.S., the entire contents of which are incorporated herein by reference.

FIELD OF THE INVENTION

The embodiments discussed herein are related to a paper sheet handling apparatus and foreign body sensing mechanism that sense a foreign body.

BACKGROUND OF THE INVENTION

Conventionally, customers have inserted a wad of banknotes bundled with, for example, clips, a staple, or a rubber band into a bill recycle unit (BRU) of an automated teller machine (ATM).

After the banknotes are inserted, the automated teller machine attempts to feed out the banknotes one by one. However, the automated teller machine cannot feed out the banknotes because they are bundled, and hence a feeding error or transport jam occurs. A coin accidentally included with a wad of banknotes could cause a feeding error or transport jam.

An apparatus has been proposed wherein, from the fact that a foreign matter detecting sensor has been covered up, the apparatus detects that a wad of banknotes is not passing between but is displacing a feed roller and a gate roller, and this apparatus determines that foreign matter has been detected (see for example Japanese Laid-open Patent Publication No. 2008-210303).

An apparatus is known that detects a foreign body using a voltage (see for example Japanese Laid-open Patent Publication No. 2008-40876). An apparatus is also known that detects a foreign body according to the fact that movement of a pressing plate for pressing banknotes is terminated before the movement is completed (see for example Japanese Laid-open Patent Publication No. 2003-281602).

In addition, an apparatus is known that detects a foreign body according to an impedance variation in detection coil means (see for example Japanese Examined Patent Application Publication No. 07-76993). An apparatus is also known that detects a foreign body using a metal detection coil (see for example Japanese Laid-open Patent Publication No. 08-335288).

BRIEF SUMMARY OF THE INVENTION

A disclosed paper sheet handling apparatus includes: a paper sheet insertion unit into which a plurality of paper sheets are inserted; a first plate provided at the paper sheet insertion unit; a second plate provided at the paper sheet insertion unit and that holds the plurality of paper sheets in a sandwiching manner with the first plate; a pressure distribution sensing sheet provided to at least one of the first or second plate and that senses a pressure distribution on the plurality of paper sheets held by the first and second plates; and a controlling unit that determines a presence/absence of a foreign body according to the pressure distribution sensed by the pressure distribution sensing sheet.

A disclosed foreign body sensing mechanism includes: a first plate provided at a paper sheet insertion unit into which a plurality of paper sheets are inserted; a second plate provided at the paper sheet insertion unit and that holds the plurality of paper sheets in a sandwiching manner with the first plate; and a pressure distribution sensing sheet provided to at least one of the first or second plate and that senses a pressure distribution on the plurality of paper sheets held by the first and second plates.

DETAILED DESCRIPTION OF THE INVENTION

The conventional foreign body sensing apparatuses described above are incapable of reliably sensing a foreign body, e.g., incapable of sensing a thin foreign body or performing the sensing of foreign bodies for a wide range, or only capable of sensing a foreign body made of a limited material (e.g., metal).

The following will describe a paper sheet handling apparatus and foreign body sensing mechanism in accordance with embodiments with reference to the drawings.

Figure 1:
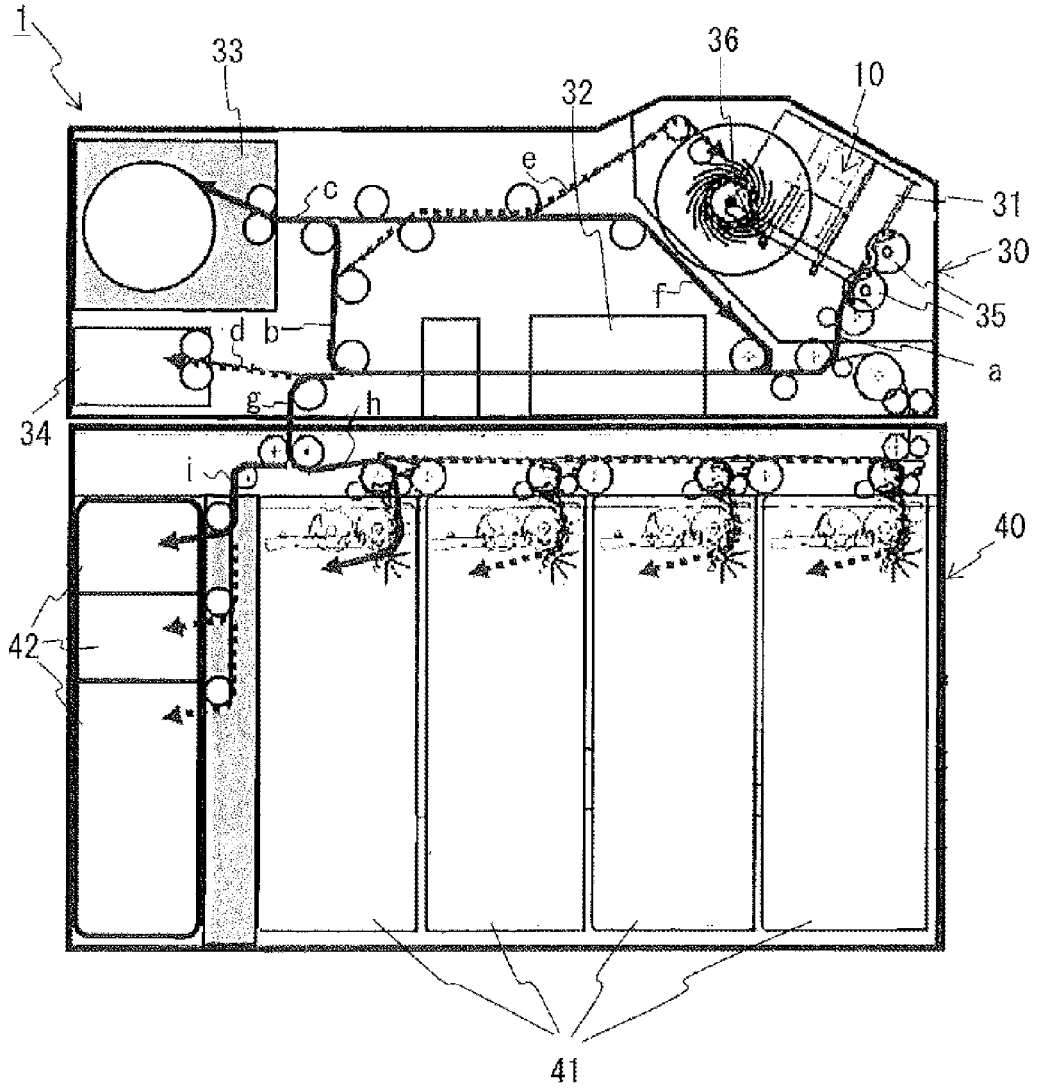
FIG. 1 illustrates the internal structure of a paper sheet handling apparatus in accordance with an embodiment.

FIG. 1 illustrates the internal structure of a paper sheet handling apparatus 1 in accordance with an embodiment.

FIGS. 2A-2D illustrate an operation of a foreign body sensing mechanism 10 in accordance with an embodiment.

The paper sheet handling apparatus 1 depicted in FIG. 1 is, for example, an automated teller machine (ATM) and includes a foreign body sensing mechanism 10, a controlling unit 20 depicted in FIG. 2, an upper module 30, and a lower module 40.

The upper module 30 includes a paper sheet insertion unit 31, a judgement unit 32, a normal note temporary retainment unit 33, a rejected note temporary retainment unit 34, and feeding rollers 35.

A customer inserts banknotes 100, i.e., an example of exemplary paper sheets, into the paper sheet insertion unit 31.

The judgement unit 32 is located below the back of the paper sheet insertion unit 31 and judges which of a normal note or a reception-rejected note (e.g., a fake note) a banknote 100 is.

The normal note temporary retainment unit 33 is located in an upper backmost portion of the upper module 30 and temporarily retains normal notes of the banknotes 100.

The rejected note temporary retainment unit 34 is located below the normal note temporary retainment unit 33 and temporarily retains a reception-rejected note (e.g., a forged note) of the banknotes 100.

The feeding rollers 35 feed a banknote 100 inserted into the paper sheet insertion unit 31 to a transport path (a) leading to the judgement unit 32.

The lower module 40 includes, for example, four recycle cassettes 41 and three reject boxes 42.

The four recycle cassettes 41 are large accumulation containers and are arranged to essentially occupy the entirety of the space within the lower module 40.

The reject boxes 42 are located within a rear end of the lower module 40. Banknotes 100 that are not to be recycled or banknotes 100 that are not suitable to be recycled (dirty or torn notes) are accumulated in the reject boxes 42.

Large and small circles depicted in FIG. 1 indicate rollers for guiding the banknotes 100, single rollers pressing against and separated from the former rollers by a transport belt, or paired rollers pressing against each other to transport the banknotes 100. Arrows indicated by thick solid lines or broken lines between the rollers represent a banknote transport belt or a banknote transport path. Note that switching gates provided at forked portions of the transport path are not illustrated in FIG. 1.

The banknotes 100 that the feeding rollers 35 feed one by one from the paper sheet insertion unit 31 to the transport path (a) pass through the judgement unit 32. From among the banknotes that have passed through the judgement unit 32, normal notes are, according to a result of the judgement, transported by transport paths (b) and (c) and then put into the normal note temporary retainment unit 33.

A banknote 100 judged to be a reception-rejected note (e.g., a fake note) passes through the judgement unit 32, and then this banknote is transported to the transport path (d) and is put into the rejected note temporary retainment unit 34. A banknote 100 unable to be judged by the judgement unit 32 due to, for example, skewed advancement or buckling is transported to the transport paths (b) and (e), and is returned to the paper sheet insertion unit 31 via an impeller 36 when all of the banknotes 100 are judged.

Then, a displaying unit (not illustrated) provided on a customer operation side of the paper sheet handling apparatus 1 displays information of the received banknotes 100. When the customer uses an input panel (not illustrated) to give an instruction to deposit only normal notes within the normal note temporary retainment unit 33, the normal notes are fed out of the normal note temporary retainment unit 33 and pass through the judgement unit 32 via transport paths (c) and (f).

A banknote 100 judged in the judgement to be a banknote with a high recycle rate passes via transport paths (g) and (h) and is put in a predetermined recycle cassette 41. A banknote 100 judged to be a banknote of a denomination with a low recycle rate and a banknote 100 that, at a later time, the bank judges to be a bad banknote 100 that needs to be replaced, e.g., a dirty banknote, pass via transport paths (g) and (i) are put in a predetermined reject box 42.

As illustrated in FIGS. 2A-2D, the foreign body sensing mechanism 10 includes a stage 11, i.e., an example of the first plate, a pusher 12, i.e., an example of the second plate, and pressure distribution sensing sheets 13 and 14.

The stage 11 and the pusher 12 face each other within the paper sheet insertion unit 31, i.e., a unit into which a plurality of banknotes 100 are inserted ("a plurality of banknotes" will hereinafter be referred to as "a wad of banknotes").

In an embodiment, the stage 11 and the pusher 12 can move parallel to a placement surface 31*a* of the paper sheet insertion unit 31, i.e., a surface on which a banknote 100 is placed. When the stage 11 approaches the pusher 12, the stage 11 and the pusher 12 sandwich a wad of banknotes 100, and this will be described hereinafter in detail.

The placement surface 31*a* of the paper sheet insertion unit 31 is inclined relative to a horizontal plane in a manner such that a portion on the pusher-12 side is located higher than a portion on the stage-11 side. In one possible example, the stage 11 and the pusher 12 are inclined relative to a vertical plane in a manner such that the pressure distribution sensing sheets 13 and 14 become orthogonal to the placement surface 31*a*.

The pressure distribution sensing sheets 13 and 14 are provided, e.g., stuck, on surfaces of both the stage 11 and pusher 12 that a banknote 100 abuts. The pressure distribution sensing sheets 13 and 14 may be larger than a plurality of types of banknotes 100 that could possibly be inserted. The pressure distribution sensing sheets 13 and 14 may be provided on one of the stage 11 or the pusher 12, but, for accuracy of sensing, it is more preferable that the pressure distribution sensing sheets 13 and 14 be provided on both the stage 11 and the pusher 12.

A pressure distribution sensed by the pressure distribution sensing sheets 13 and 14 is transmitted to the controlling unit 20 depicted in FIGS. 2A-2D. The controlling unit 20 determines the presence/absence of a foreign body using the pressure distribution sensed by the pressure distribution sensing sheets 13 and 14. The controlling unit 20 is, for example, a computer that controls operations of the entirety of the paper sheet handling apparatus 1.

Figure 3:
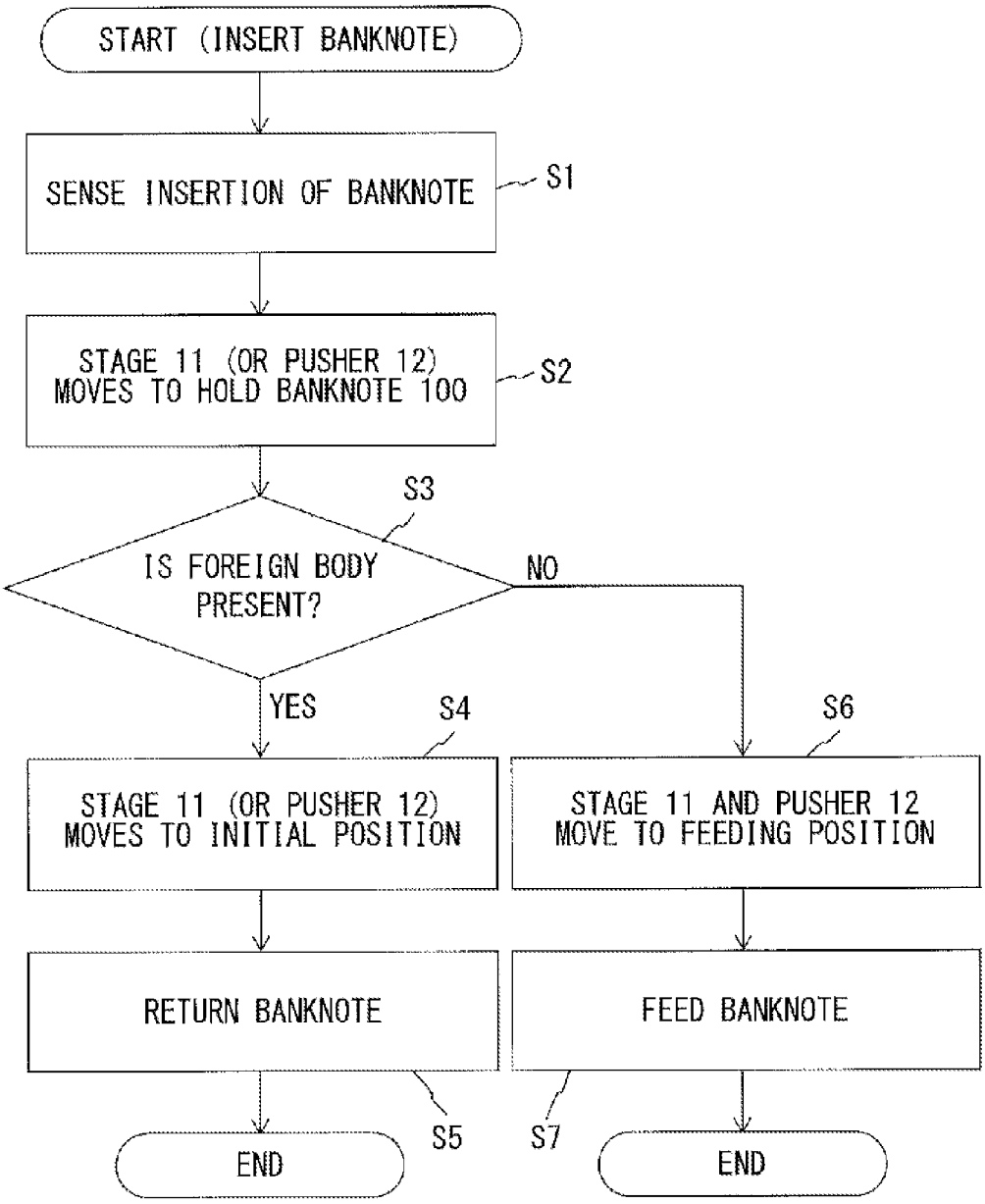
FIG. 3 is a flowchart illustrating the outline of an operation related to the sensing of a foreign body in accordance with an embodiment.

FIG. 3 is a flowchart illustrating the outline of an operation related to the sensing of a foreign body in accordance with an embodiment.

Figure 2A:
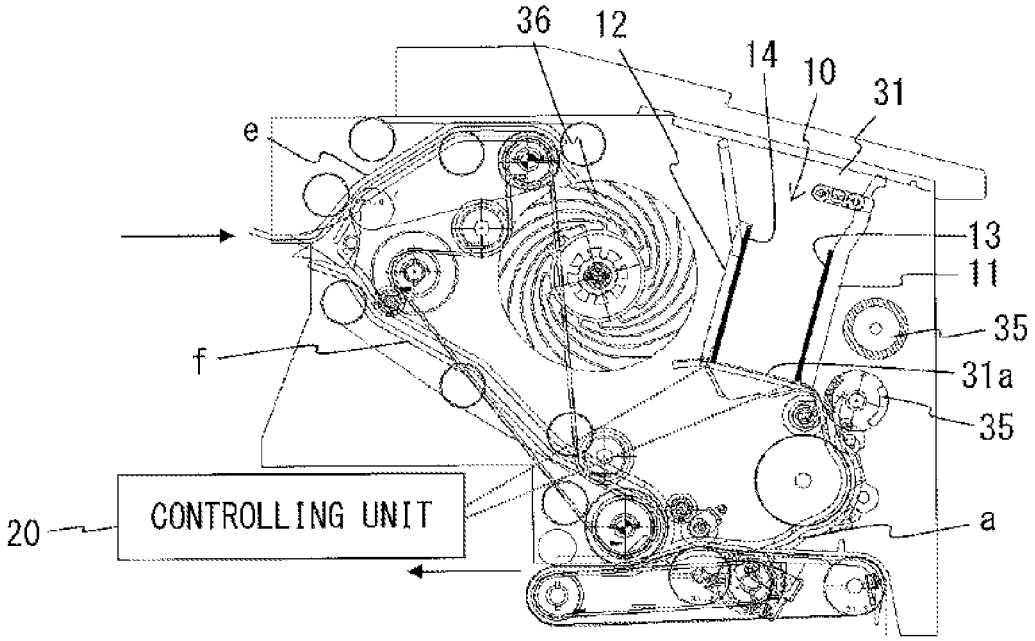
FIG. 2A illustrates an operation of a foreign body sensing mechanism in accordance with an embodiment (No. 1)
Figure 2B:
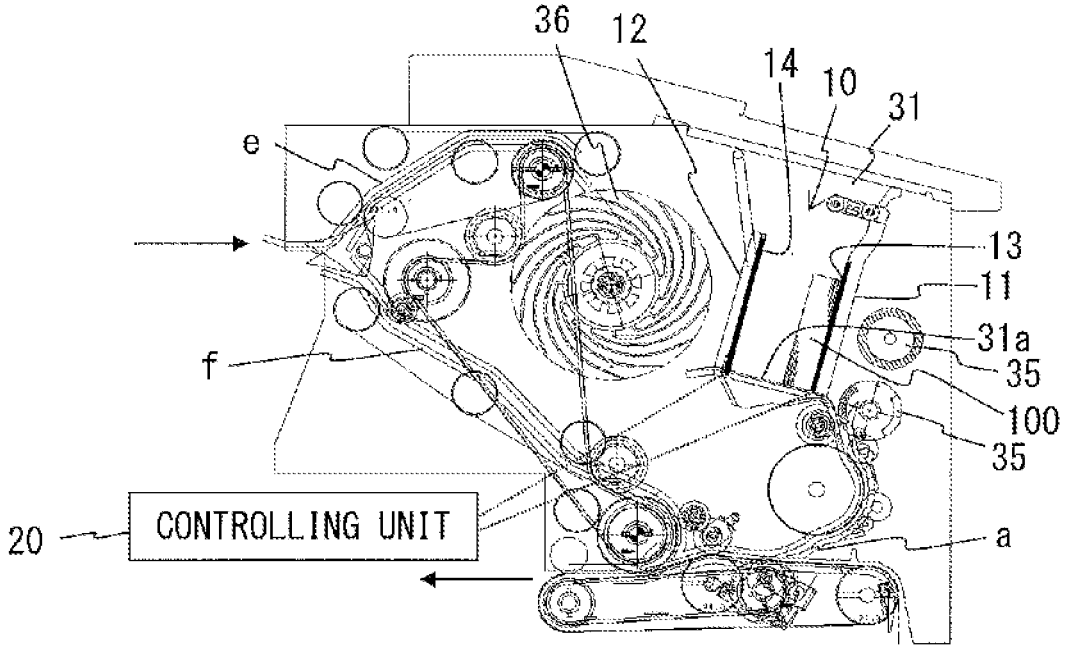
FIG. 2B illustrates an operation of a foreign body sensing mechanism in accordance with an embodiment (No. 2)

When, as depicted in FIG. 2B, a wad of banknotes 100 is inserted into the paper sheet insertion unit 31, an insertion sensing sensor (not illustrated) senses the insertion of the wad of banknotes 100 (step S1). Note that inserted wads of banknotes 100 are stacked up and come in contact with the placement surface 31*a* and stage 11 of the paper sheet insertion unit 31.

Figure 2C:
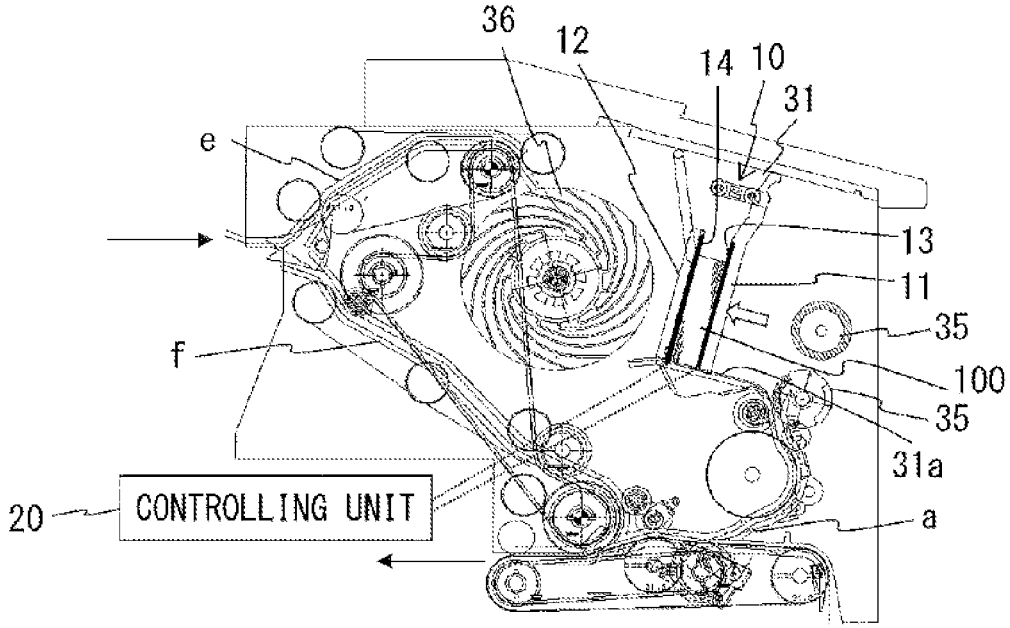
FIG. 2C illustrates an operation of a foreign body sensing mechanism in accordance with an embodiment (No. 3)

Subsequently, the stage 11 moves to approach the pusher 12 as depicted in FIG. 2C, with the result that the stage 11 and the pusher 12 hold the wad of banknotes 100 in a sandwiching manner with each other. Note that, instead of the stage 11 moving, the pusher 12 may move to approach the stage 11. Alternatively, the stage 11 and the pusher 12 may move to approach each other.

Figure 2D:
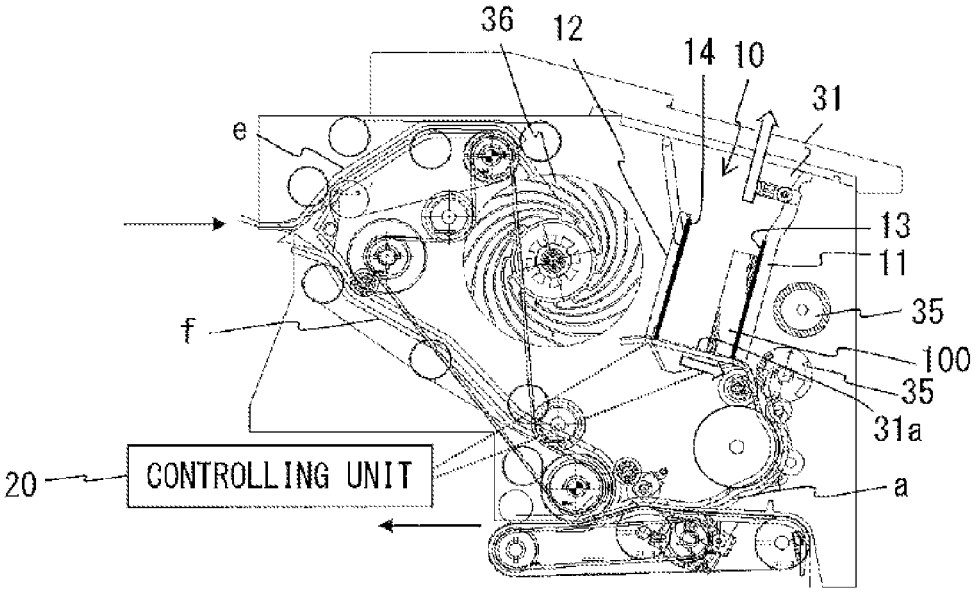
FIG. 2D illustrates an operation of a foreign body sensing mechanism in accordance with an embodiment (No. 4)

When the controlling unit 20 determines that a foreign body is present (YES in S3), the stage 11 moves as depicted in FIG. 2D, to an initial position, i.e., a position depicted in FIG. 2A at which the stage 11 is located when the wad of banknotes 100 is inserted into the paper sheet insertion unit 31 (S4). Note that the sensing of a foreign body will be described hereinafter in detail. As described above, the stage 11 first moves to approach the pusher 12. However, at a moment when the controlling unit 20 determines that a foreign body is present according to reception of a pressure distribution sensed by the pressure distribution sensing sheets 13 and 14 after the stage 11 has started the approaching movement, the stage 11 may stop the approaching movement and may move to the initial position.

Next, to prevent the foreign body from being received within the paper sheet handling apparatus 1, the paper sheet insertion unit 31 opens to return the wad of banknotes 100 to the customer (S5).

While, When the controlling unit 20 determines that a foreign body is not present (NO in S3), the stage 11 and the pusher 12 move to a feeding position at which these elements are located when the feeding rollers 35 feed banknotes 100 (S6).

The feeding rollers 35 feed the banknotes 100 one by one onto a predetermined transport path (S7). The stage 11 has formed thereon an opening into which the feeding rollers 35 are inserted, and the feeding rollers 35 may feed the banknotes 100 through the stage 11.

In regard to the presence/absence of a foreign body, the controlling unit 20 may detect an abutment region R between the pressure distribution sensing sheet 13 or 14 and the wad of banknotes 100 (see FIGS. 4A-4D and 5) from among pressure distributions sensed by the pressure distribution sensing sheets 13 and 14, and may determine the presence/absence of a foreign body within only the abutment region R. The pressure distribution sensing sheets 13 and 14 sense a pressure within the abutment region R, but, for example, these sheets may detect a pressure within a rectangular region determined according to the coordinates of four corners of the abutment region R.

Figure 4A:
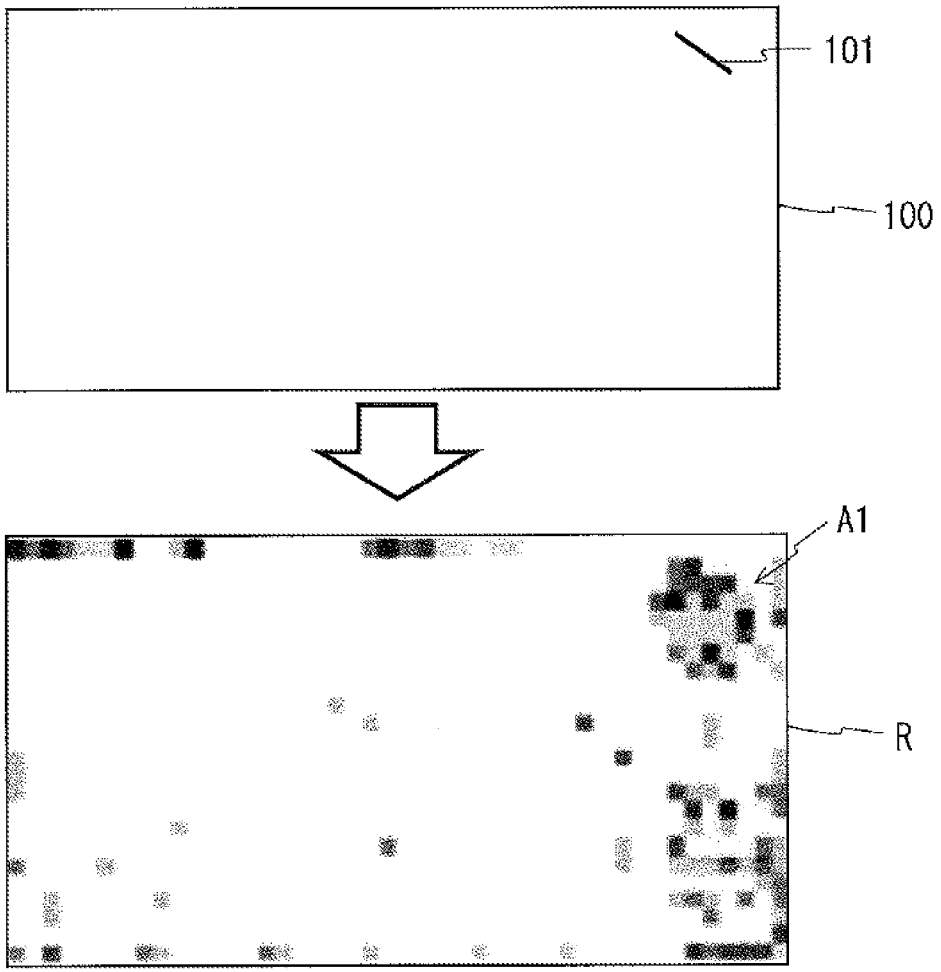
FIG. 4A illustrates an example of pressure distribution in accordance with an embodiment (No. 1)

When, as depicted in FIG. 4A, a stapled section 101 is on an upper right portion of a wad of banknotes 100, the pressure sensed at an upper right portion of the abutment region R partly exceeds a predetermined pressure standard (e.g., an arbitrary multiple of a normal value) (corresponding to a highly colored portion in FIG. 4A). When a collection of portions exceeding the pressure standard (consecutive portions) reaches a predetermined area standard (e.g., a few square centimeters), the controlling unit 20 may determine that a foreign body (A1) is present. The pressure sensed at a lower-right portion of the abutment region R also partly exceeds the pressure standard as depicted in FIG. 4A, but this portion does not reach the area standard. Hence, the controlling unit 20 does not determine that an abnormality is present.

Figure 4B:
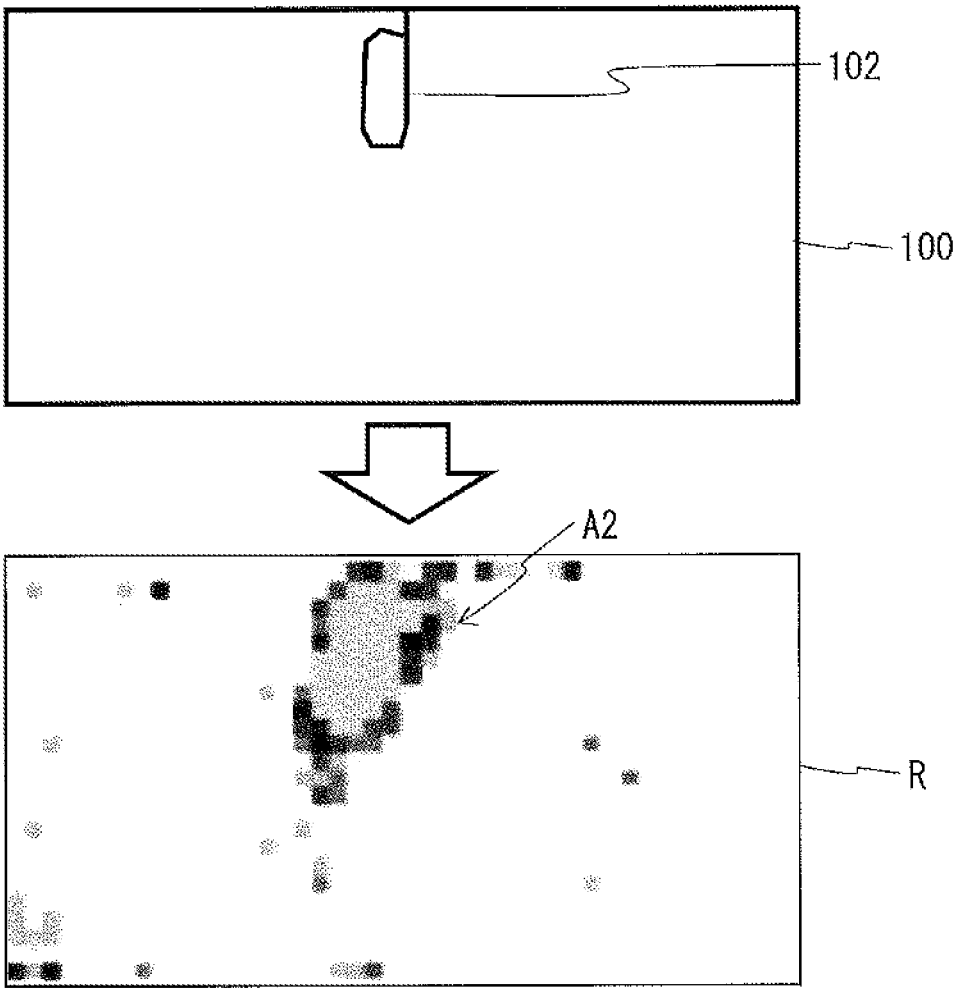
FIG. 4B illustrates an example of pressure distribution in accordance with an embodiment (No. 2)

When, as depicted in FIG. 4B, a clipped section 102 is on an upper central portion of a wad of banknotes 100, the pressure sensed at an upper central portion of the abutment region R partly exceeds the predetermined pressure standard. When a collection of such portions reaches the predetermined area standard, it is determined that a foreign body (A2) is present.

Figure 4C:
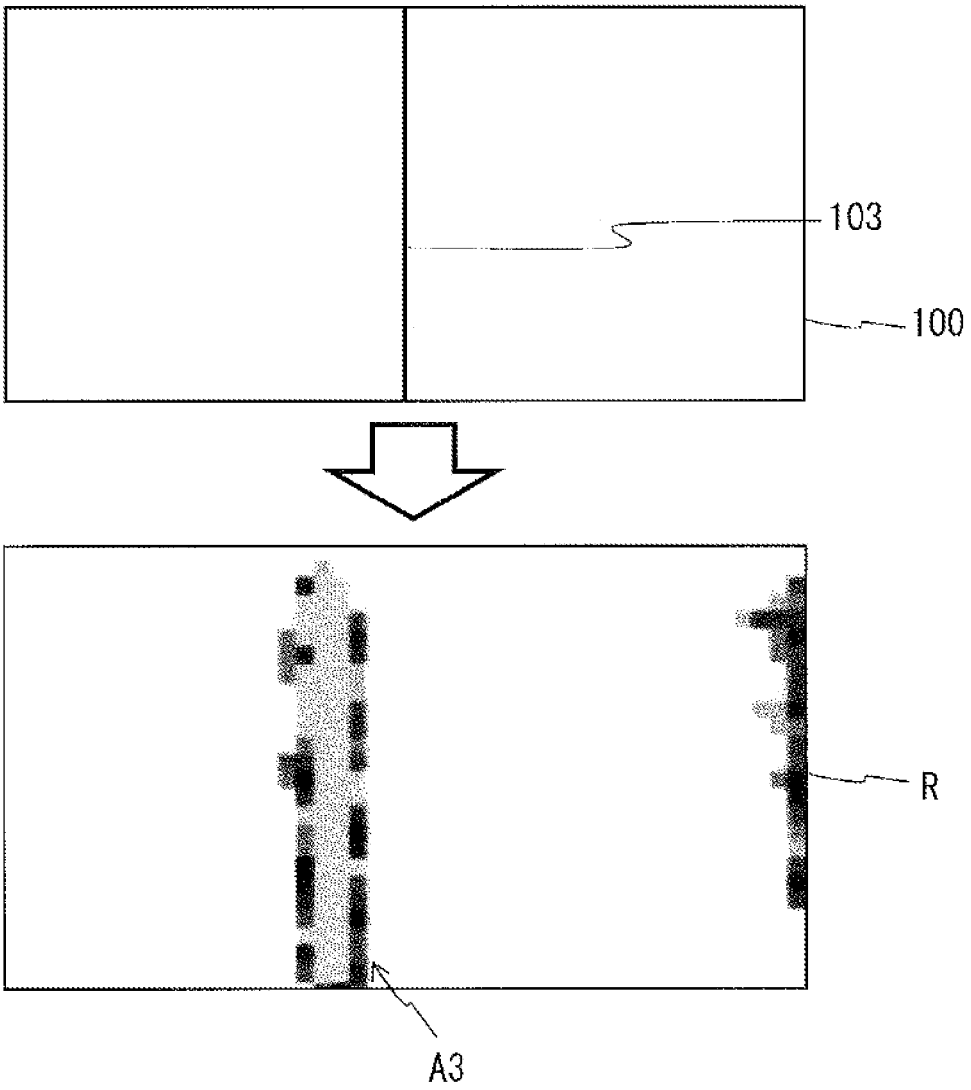
FIG. 4C illustrates an example of pressure distribution in accordance with an embodiment (No. 3)

When, as depicted in FIG. 4C, a rubber-band-bundled section 103 is on a central portion of a wad of banknotes 100, the pressure sensed at portions of the abutment region R close to the rubber-band-bundled section 103 exceeds the predetermined pressure standard. When a collection of such portions reaches the predetermined area standard, it is determined that a foreign body is present (A3). A right-end portion of the abutment region R is partly subject to a pressure higher than the pressure applied to other portions, as depicted in FIG. 4C, but the pressure sensed at a collection of such portions does not exceed the predetermined pressure standard. Accordingly, an arrangement may be made to not determine that a foreign body is present in consideration of such portions alone.

Figure 4D:
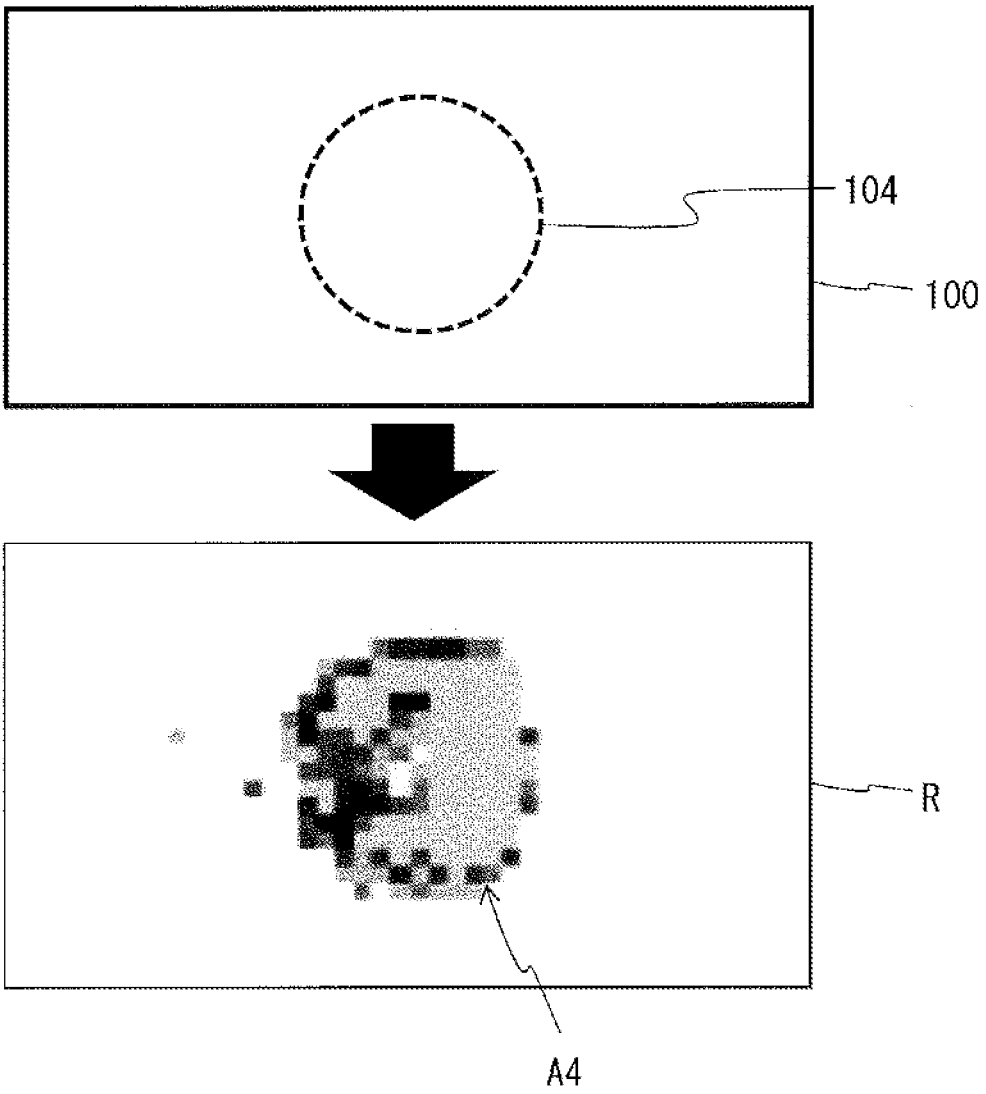
FIG. 4D illustrates an example of pressure distribution in accordance with an embodiment (No. 4)

When, as depicted in FIG. 4D, a coin 104 is on the center of a wad of banknotes 100, the pressure sensed at the center of the abutment region R partly exceeds the predetermined pressure standard. When a collection of such portions reaches the predetermined area standard, it is determined that a foreign body (A4) is present.

Figure 5:
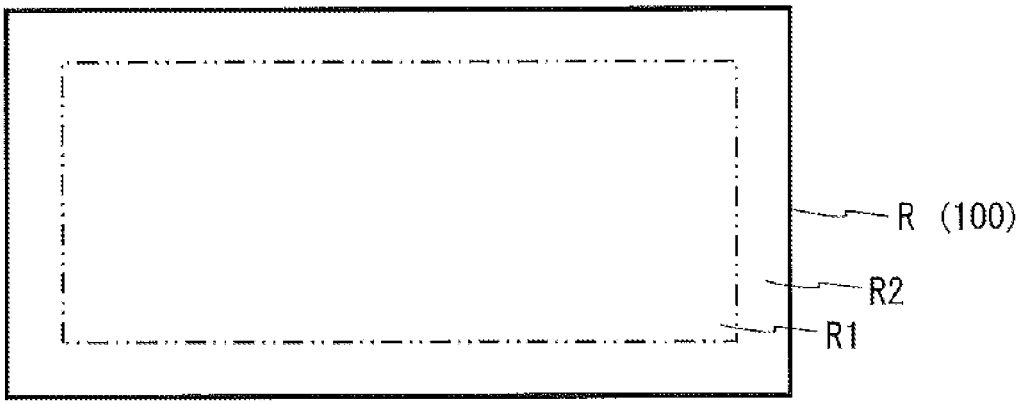
FIG. 5 illustrates a central region and peripheral region of an abutment region (banknote) in accordance with an embodiment.

As depicted in FIG. 5, the controlling unit 20 may determine the presence/absence of a foreign body using different standards for pressure abnormality in a central region R1 of the abutment region R (e.g., portions other than the peripheral region R2) and for pressure abnormality in a peripheral region R2 of the abutment region R (e.g., the portion of the abutment region R within a certain distance of the periphery) in a manner such that a foreign body can be more readily sensed in the peripheral region R2 of the abutment region R than in the central region R1 of the abutment region R. A determination standard is, for example, making the pressure standard for the peripheral region R2 lower than that for the central region R1, or making the area standard for a collection of portions of the peripheral region R2 exceeding the pressure standard narrower than the area standard for a collection of portions of the central region R1 exceeding the pressure standard. These allow a foreign body within the peripheral region R2 to be sensed more readily than a foreign body within the central region R1.

In the embodiment described above, the pressure distribution sensing sheets 13 and 14 are provided to at least one of the stage 11, i.e., an example of the first plate, or the pusher 12, i.e., an example of the second plate, and sense a pressure distribution on a plurality of banknotes 100 held by the stage 11 and the pusher 12 in a sandwiching manner with each other. Hence, the sensing of foreign bodies may be performed for a wide range, regardless of the thickness thereof or material therefor. Thus, the embodiment can increase the accuracy of the sensing of foreign bodies.

In the embodiment, the pressure distribution sensing sheets 13 and 14 are provided at both the stage 11, i.e., an example of the first plate, and the pusher 12, i.e., an example of the second plate. This further increases the accuracy of the sensing of foreign bodies.

In the embodiment, the controlling unit 20 detects an abutment region R between the pressure distribution sensing sheet 13 or 14 and the wad of banknotes 100 from among pressure distributions sensed by the pressure distribution sensing sheets 13 and 14, and determines the presence/absence of a foreign body within the abutment region R. Accordingly, only foreign bodies accidentally put together with a wad of banknotes 100 can be sensed by performing simple control.

In the embodiment, the controlling unit 20 detects an abutment region R between the pressure distribution sensing sheet 13 or 14 and the wad of banknotes 100 from among pressure distributions sensed by the pressure distribution sensing sheet or 14; the controlling unit 20 may determine the presence/absence of a foreign body using different standards for pressure abnormality in a central region R1 of the abutment region R and for pressure abnormality in a peripheral region R2 of the abutment region R in a manner such that a foreign body can be more readily sensed in the peripheral region R2 than in the central region R1. Many foreign bodies such as the stapled section 101 depicted in FIG. 4A, the clipped section 102 depicted in FIG. 4B, and the rubber-band-bundled section 103 are located at least partly within the peripheral region R2, and foreign bodies within the peripheral region R2 can be sensed without fail.

For assumed foreign bodies (e.g., foreign bodies in FIGS. 4A-4D), pressure distribution patterns detected in advance may be stored as templates to be compared with a pressure distribution result detected by the pressure distribution sensing sheets 13 and 14, so that it can be determined what that foreign body is, and a host apparatus and an operator can be notified of what that foreign body is.

What is claimed is:

1. A paper sheet handling apparatus comprising:

a paper sheet insertion unit into which a plurality of paper sheets are inserted;

a first plate provided at the paper sheet insertion unit;

a second plate provided at the paper sheet insertion unit and that holds the plurality of paper sheets in a sandwiching manner with the first plate;

a pressure distribution sensing sheet provided to at least one of the first or second plate and that senses a pressure distribution on the plurality of paper sheets held by the first and second plates; and a controlling unit that determines a presence/absence of a foreign body according to the pressure distribution sensed by the pressure distribution sensing sheet, wherein the controlling unit detects an abutment region between the pressure distribution sensing sheet and the paper sheets from among the pressure distributions sensed by the pressure distribution sensing sheet, and determines the presence/absence of a foreign body using different standards for pressure abnormality in a central region of the abutment region and for pressure abnormality in a peripheral region of the abutment region in a manner such that a foreign body is more readily sensed in the peripheral region than in the central region.

2. The paper sheet handling apparatus according to claim 1, wherein the pressure distribution sensing sheet is provided at both the first and second plates.

3. The paper sheet handling apparatus according to claim 1, wherein the controlling unit determines a foreign body by comparing the pressure distribution sensed by the pressure distribution sensing sheet with a pressure distribution registered in advance.

* * * * *